US005679030A

United States Patent [19]

Chadbourne et al.

[11] Patent Number: 5,679,030

[45] Date of Patent: Oct. 21, 1997

[54] ELECTRICAL GROUND CONNECTOR

[75] Inventors: Richard Chadbourne, Merrimack; Armand T. Montminy, Manchester, both of N.H.

[73] Assignee: Framatome Connectors USA Inc., Norwalk, Conn.

[21] Appl. No.: 693,676

[22] Filed: Aug. 13, 1996

[51] Int. Cl.[6] ..... H01R 4/32

[52] U.S. Cl. ..... 439/778

[58] Field of Search ..... 439/778, 779, 439/102, 98

[56] References Cited

U.S. PATENT DOCUMENTS 2,816,274 12/1957 Barlow ..... 439/778

OTHER PUBLICATIONS

Burndy Electrical Catalog, "Servit" Connector, one page.
Burndy Electrical Catalog, Type EQC632C Connector, one page.
Technical Drawing of Type EQC632C Connector.

*Primary Examiner*—Neil Abrams
*Assistant Examiner*—T. C. Patel
*Attorney, Agent, or Firm*—Perman & Green, LLP

[57] ABSTRACT

An electrical connector for grounding an electrical conductor. The connector has a base, a U-shaped fastener and a nut. The base is a one-piece metal member with a threaded stud, an elongate seat along one exterior side, and a hole through the base located between the seat and the stud. The U-shaped fastener has a first leg that extends through the hole, a second leg that extends along an exterior side of the base, and a head located opposite the seat on the base. The nut is attached to the legs of the U-shaped fastener on a side of the base opposite from the side of the base facing the head of the U-shaped fastener.

13 Claims, 3 Drawing Sheets

ELECTRICAL GROUND CONNECTOR

BACKGROUND OF THE INVENTION

1. Field of the Invention

The present invention relates to electrical connectors and, more particularly to a grounding connector.

2. Prior Art

The Burndy Electrical division of Framatome Connectors USA Inc. manufactures and sells transformer ground connectors known as Type EQC632C that have a base with a threaded stud and two seats on opposite sides of a through-hole. An eyelet shaped piece extends through the through-hole and has a nut attached to it. A hole of the eyelet shaped piece is aligned between the two seats for a conductor to pass through the hole and be pressed against the seats by the eyelet shaped piece when the nut is tightened.

SUMMARY OF THE INVENTION

In accordance with one embodiment of the present invention an electrical ground connector is provided comprising a base, a first fastener, and a second fastener. The base is made of electrically conductive material. The base has a first connection section and a second connection section. The second connection section has a hole therethrough. The first fastener has a general U-shape with a head and two legs extending from the head. A first one of the legs extends through the hole in the base and a second one of the legs extends along an exterior of the base. The second fastener is attached to the legs of the first fastener. A portion of the base is located between the legs and between the head of the first fastener and the second fastener.

In accordance with another embodiment of the present invention an electrical ground connector is provided comprising a one-piece metal base, a one-piece U-shaped fastener, and a nut. The base has a threaded stud, an elongate seat along a first side of the base, and a first hole extending through the base between the seat and the threaded stud. The U-shaped fastener has a first leg extending through the hole in the base. A second leg of the U-shaped fastener extends along an exterior side of the base. A head of the U-shaped fastener is positioned opposite a portion of the seat at the first side of the base. The first and second legs have threads thereon. The nut is threadingly attached to the threads on the first and second legs of the U-shaped fastener. The nut is located on a second side of the base opposite from the first side of the base.

In accordance with another embodiment of the present invention an electrical ground connector is provided comprising a one-piece metal base, a one-piece U-shaped fastener, and a nut. The base has a threaded stud, an elongate seat along a first side of the base, and two holes extending through the base on opposite sides of the seat. The U-shaped fastener has a first leg extending through a first one of the two holes, a second leg extending through a second one of the two holes, and a head located opposite the seat. The nut is threadingly attached to the first and second legs of the U-shaped fastener on a second side of the base opposite to the first side of the base.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
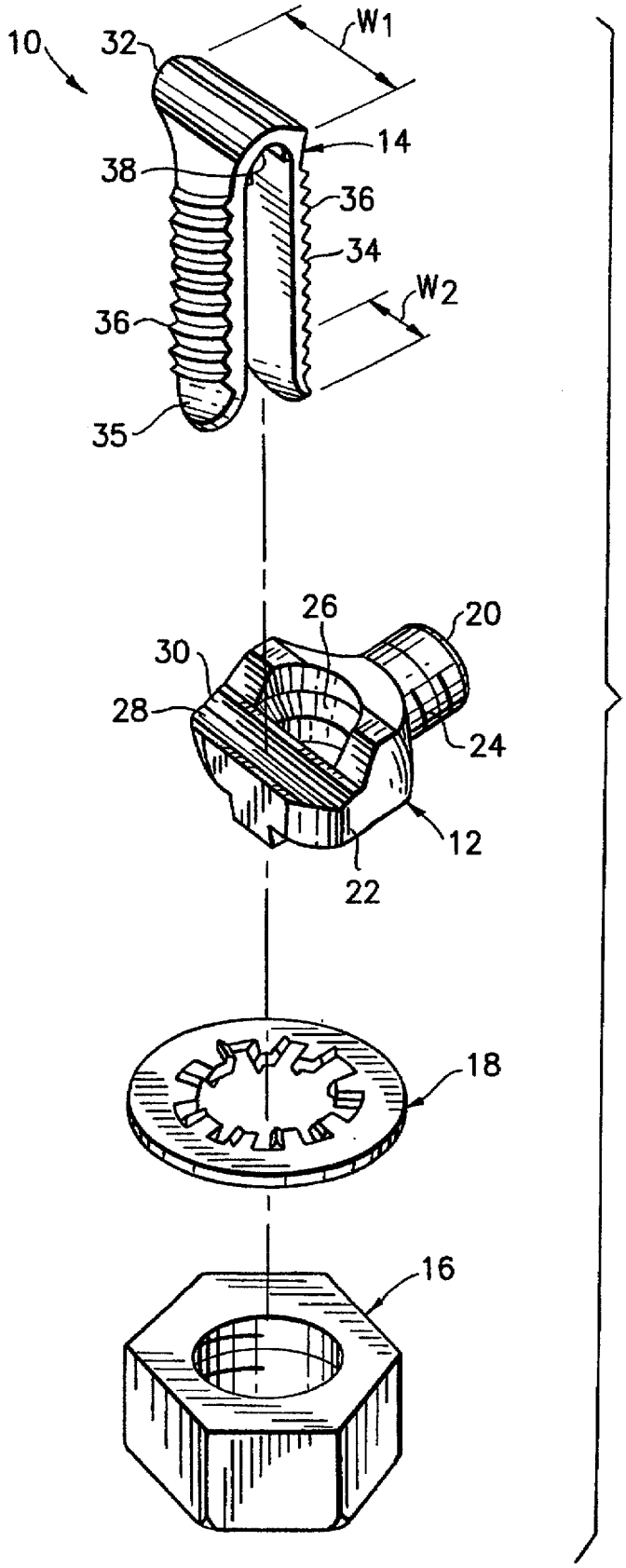
FIG. 1 is an exploded perspective view of an electrical connector incorporating features of the present invention.

Referring to FIG. 1, there is shown an exploded perspective view of an electrical connector 10 incorporating features of the present invention. Although the features of the present invention will be described with reference to the embodiments shown in the drawings, it should be understood that features of the present invention can be embodied in many different forms of alternate embodiments. In addition, any suitable size, shape or type of elements or materials could be used.

Figure 4:
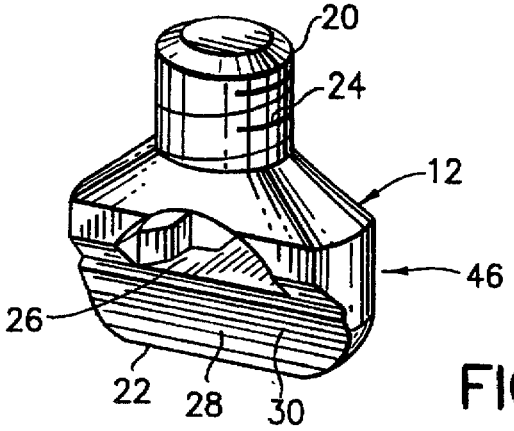
FIG. 4 is a perspective view of the base of the connector shown in FIG. 1.

The connector 10 generally comprises a base 12, a first fastener 14, a second fastener 16, and a washer 18. In an alternate embodiment the washer 18 need not be provided. Referring also to FIG. 4, the base 12 is preferably a one-piece metal member made of electrically conductive material. However, in an alternate embodiment multiple members could be combined to form the base. The base 12 has a first connection section 20 and a second connector section 22. The first section 20 has a single threaded stud 24. However, in alternate embodiments other types of first connection sections could be provided. The stud 24 is provided to allow the base 12 to be fixedly and electrically connected to another member (not shown), such as a member that is part of an electrical ground. The other member would have a threaded aperture to receive the threaded stud 24. The second connection section 22 includes a single hole 26. The hole 26 has a general semi-circular cross-sectional shape and extends through the base 12 generally transverse to the longitudinal axis of the stud 24. A first side 28 of the base 12 has a general V-shaped recessed elongate seat 30. The hole 26 is located between the seat 30 and the stud 24. The seat 30 extends generally transverse to the direction of the hole 26 and the center axis of the stud 24. However, in alternate embodiments, other configurations could be provided.

Figure 2:
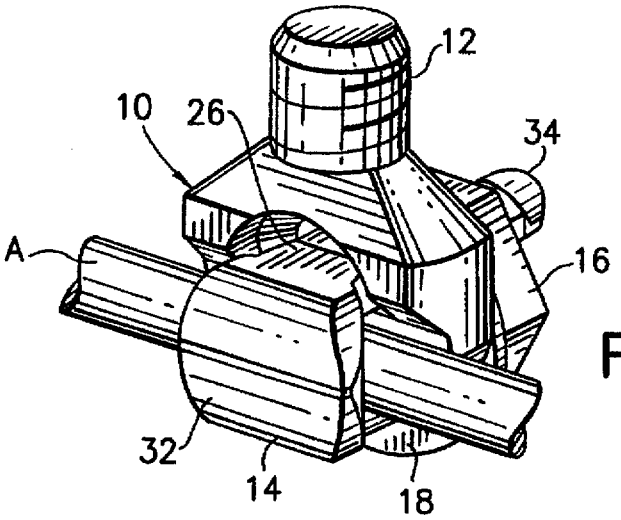
FIG. 2 is a perspective view of the connector shown in FIG. 1 attached to a conductor.
Figure 3:
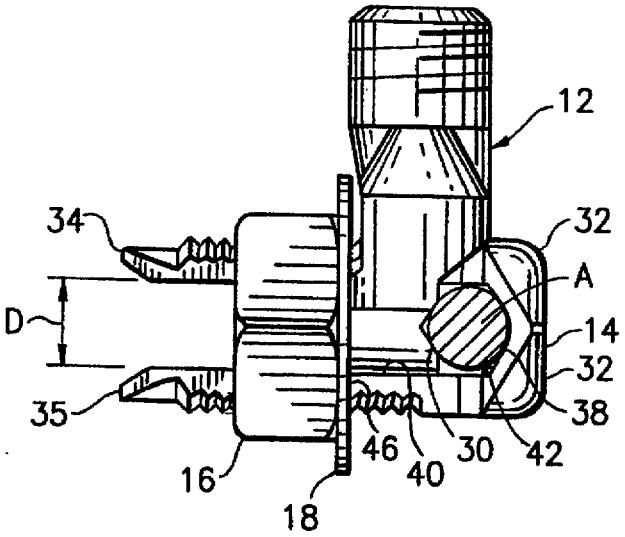
FIG. 3 is a perspective view of the connector shown in FIG. 2.

The first fastener 14 is preferably a one-piece metal member made of electrically conductive material. The first fastener 14 has a general U-shape with a head 32 and two legs 34, 35. The legs 34,35 have threads 36 on their exterior sides. The legs 34,35 have general cycloidal cross-sectional shapes. The head 32 has a width $W_1$ that is wider than the widths $W_2$ of the legs 34,35. The head 32 also has a general V-shaped recessed seat 38 between the two legs 34,35. Referring also to FIGS. 2 and 3, the legs 34,35 are spaced from each other by a distance D. The distance D is substantially the same as the thickness of the base 12 between the hole 26 and the exterior side end 40. The first leg 34 is suitably sized and shaped to pass into and through the hole 26. When the leg 34 is passed through the hole 26, the other leg 35 extends along the exterior side end 40 of the base 12. The head 32 is thus moved into proximity over the seat 30 with the two seats 30, 38 facing each other. The area between the two seats 30, 38 forms a conductor receiving area 42 for the first conductor A (see FIG. 3).

The second fastener 16 is preferably a one-piece metal made of electrically conductive material. In the embodiment shown, the second fastener 16 is a threaded nut. The size of the threaded aperture 44 is adapted to screw onto the two legs 34, 35 of the first fastener 14. With the first fastener 14 positioned on the base 12, with the first leg 34 in the hole 26 and the second leg 35 along the exterior side end 40, the nut 16 is screwed onto the legs 34, 35 at a second side 46 of the base 12 that is opposite form the first side 28 of the base 12. The washer 18 is positioned between the nut 16 and the second side 28.

As the nut 16 is screwed onto the legs 34, 35, the head 32 of the first fastener 14 is pulled towards the first side 28. Thus, the two seats 30, 38 move towards each other to clamp the conductor A therebetween. This fixedly clamps the connector 10 and the conductor A together. With the stud 24 threadingly attached to another member (not shown), the connector 10 fixedly and electrically connects the conductor A to the other member to thereby ground the conductor A.

Figure 5:
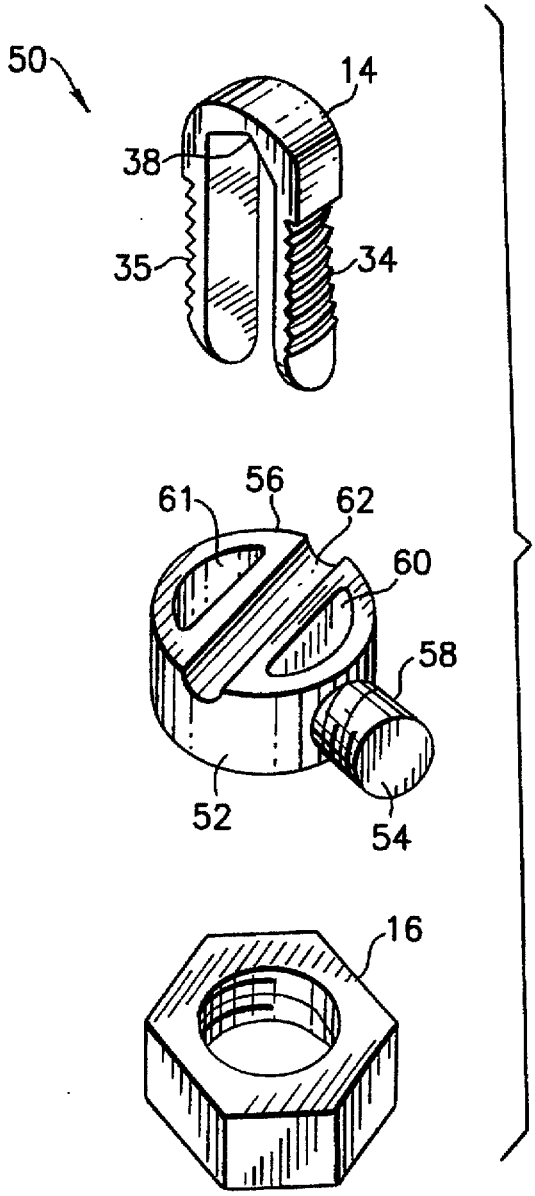
FIG. 5 is an exploded perspective view of an alternate embodiment of the present invention.

Referring now to FIG. 5, there is shown an exploded perspective view of an alternate embodiment of the present invention. The connector 50 has a base 52, the first fastener 14 and the second fastener 16. The base 52 is a one-piece metal member with first connection section 54 and a second connection section 56. The first connection section 54 has a single threaded stud 58. The second connection section 56 has two holes 60, 61 and a recessed conductor receiving seat 62. The legs 34,35 are inserted into respective ones of the holes 60,61 with the seat 38 facing the seat 62. In other alternate embodiments, other shapes of bases could be provided.

One of the principal advantages of the present invention is the quality of the electrical connection that is provided between the connector 10 or 50 and the line conductor A. The present invention, because of the increased area of contact between the seats 30, 38 or 62, 38 and the conductor A, provides an improved degree of electrical connection than in the prior art. Another principal advantage of the present invention is in regard to the cost of the ground connector relative to the old ground connector. The connectors 10, 50 can use existing SERVIT components for the first and second fasteners 14, 16. SERVIT is a trademark of Framatome Connectors USA Inc. SERVIT connectors are used to connect two line conductors to each other. Thus, the same components (14, 16) can be used for two different connection systems; one for connecting two line conductors to each other and one for connecting a line conductor to a ground. This also reduces inventory costs and manufacturing cost.

Figure 6:
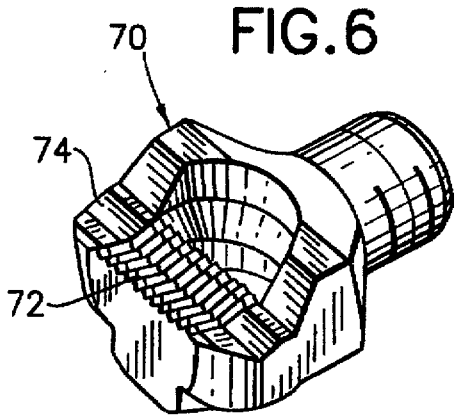
FIG. 6 is a perspective view of an alternate embodiment of a base.
Figure 7:
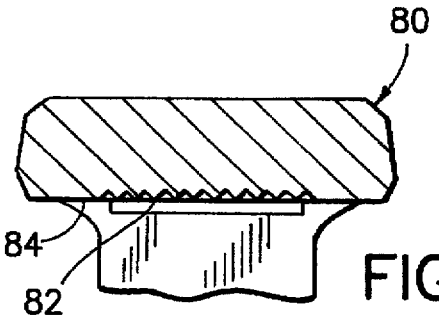
FIG. 7 is a partial cross-sectional view of the head of an alternate embodiment of a first U-shaped fastener.

Referring now to FIG. 6, an alternate embodiment of a base 70 is shown. The base 70 is substantially the same as the base 12. However, in this embodiment the base 70 has a serrated or tooth ridged area 72 along the V-shaped recessed seat 74. The serrated area 72 significantly enhances grip on the conductor. Thus, it makes it much more difficult for the conductor to be inadvertently pulled out of the clamp between the base and the first fastener. Referring also to FIG. 7, a partial cross-sectional view of an alternate embodiment of the head of a U-shaped first fastener 80 is shown. The fastener 80 is substantially the same as the fastener 14 shown in FIG. 1. However, in this embodiment the fastener 80 has a serrated or tooth ridged area 82 along the V-shaped recessed seat 84 between the two legs. The serrated area 82 is used to enhance the grip on the conductor. The fastener 80 can be used with either base 12 or base 70. Likewise, the base 70 can be used with either the first fastener 14 or the first fastener 80. It should be understood that the foregoing description is only illustrative of the invention. Various alternatives and modifications can be devised by those skilled in the art without departing from the spirit of the invention. Accordingly, the present invention is intended to embrace all such alternatives, modifications and various which fall within the scope of the appended claims.

What is claimed is:

1. An electrical ground connector comprising:

a base made of electrically conductive material, the base having a first connection section and a second connection section, the second connection section having a hole therethrough, the second connection section having an elongate seat along a first side of the base;

a first fastener having a general U-shape with a head and two legs extending from the head, a first one of the legs extending through the hole in the base and a second one of the legs being spaced from the hole; and a second fastener attached to the legs of the first fastener with a portion of the base between the legs being located between the head of the first fastener and the second fastener.

2. A connector as in claim 1 wherein the base is a one-piece metal member.

3. A connector as in claim 1 wherein the second leg extends along an exterior of the base.

4. A connector as in claim 1 wherein the second leg extends through a second hole in the base.

5. A connector as in claim 1 wherein the first connection section comprises a single threaded stud.

6. A connector as in claim 5 wherein the hole is located between the seat and the first connection section.

7. A connector as in claim 6 wherein the hole has a general semi-circular cross-section.

8. A connector as in claim 6 wherein the seat is generally transverse to a center axis of the stud.

9. A connector as in claim 8 wherein the head of the first fastener has a recessed seat between the first and second legs.

10. An electrical ground connector comprising:

a one-piece metal base having a threaded stud, an elongate seat along a first side of the base, and a hole extending through the base between the seat and the threaded stud;

a one-piece U-shaped fastener having a first leg extending through the hole in the base, a second leg extending along an exterior side of the base, and a head positioned opposite a portion of the seat at the first side of the base, the first and second legs having threads thereon; and a nut threadingly attached to the threads on the first and second legs of the U-shaped fastener, the nut being located on a second side of the base opposite from the first side of the base.

11. A connector as in claim 10 wherein the hole in the base has a general U-shaped cross section.

12. A connector as in claim 10 wherein the head of the U-shaped fastener has a recessed seat between the first and second legs.

13. A connector as in claim 10 wherein the U-shaped fastener is a one-piece member comprised of metal.

* * * * *